US006315137B1

(12) United States Patent
Mulford

(10) Patent No.: US 6,315,137 B1
(45) Date of Patent: Nov. 13, 2001

(54) STRUCTURAL CHANNEL CONNECTOR AND METHOD OF MANUFACTURE

(75) Inventor: Frederick A. Mulford, Lodi, NY (US)

(73) Assignee: Frazier Industrial Company, Long Valley, NJ (US)

( * ) Notice: Subject to any disclaimer, the term of this patent is extended or adjusted under 35 U.S.C. 154(b) by 0 days.

(21) Appl. No.: 09/140,852

(22) Filed: Aug. 27, 1998

(51) Int. Cl.[7] ..... A47B 47/00
(52) U.S. Cl. ..... 211/193
(58) Field of Search ..... 211/193, 207, 211/189, 190, 175, 208

(56) References Cited

U.S. PATENT DOCUMENTS 3,335,992 8/1967 Frazier ..... 248/245
3,489,991 1/1970 Frazier ..... 211/176
4,519,512 5/1985 Frazier et al. ..... 211/193

*Primary Examiner*—Alvin Chin-Shue
*Assistant Examiner*—Sarah Purol
(74) *Attorney, Agent, or Firm*—Joseph W. Molasky & Associates

(57) ABSTRACT

A modified structural channel member is formed to include an indented region, or detented region, within the web portion of the channel. The indented portion, in conjunction with one flange of the channel, may be used as a connector in a cantilever rack structure. Alternatively, when formed to include a detented portion, a pair of such channels may be used as a shelf support structure, with a support beam resting between the pair of detented portions. A conventional channel member may be processed by a punch and die, or alternatively, by a rolling technique, to form the modified structural channel structure of the present invention. A plate may be used in place of a channel, with the plate similarly processed to include any desired indent or detent structure.

17 Claims, 4 Drawing Sheets

FIG. 5
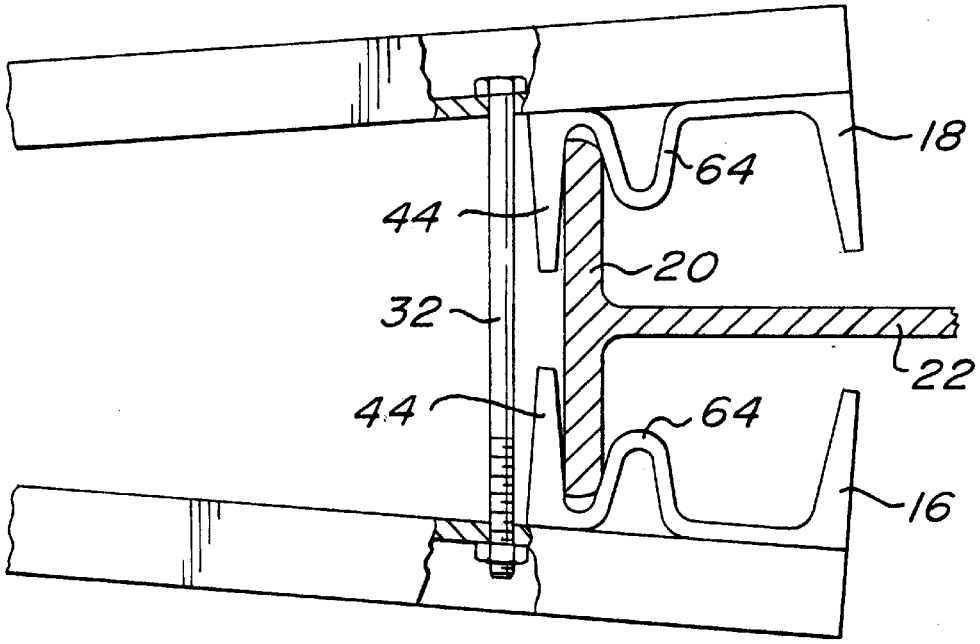
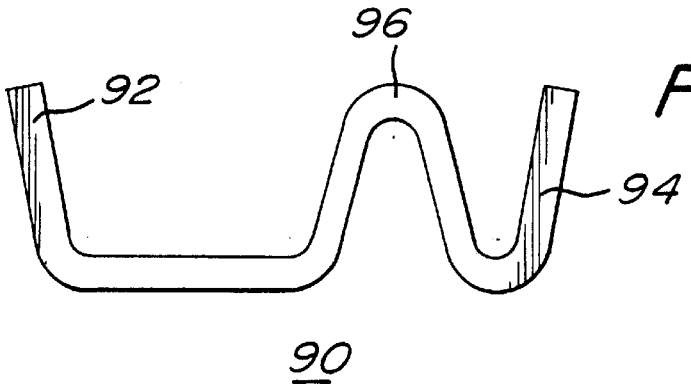
FIG. 8
FIG. 9
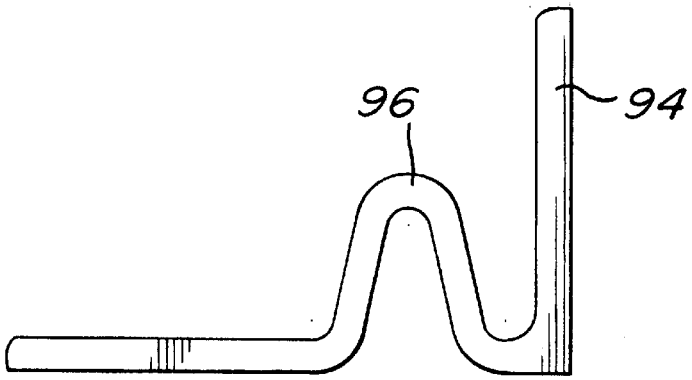

STRUCTURAL CHANNEL CONNECTOR AND METHOD OF MANUFACTURE

BACKGROUND OF THE INVENTION

1. Field of the Invention

This invention relates generally to a structural channel connector and, more particularly, to a connector for use with storage rack structures and the like.

2. Description of the Prior Art

There is an industrial need for storage facilities capable of holding heavy loads. Since the quantity and size of the objects which are being stored may vary from time to time, the spatial dimensions of the rack should be variable so that it can accommodate whatever size material it is called upon to receive. Also, the arms must be capable of resisting slippage or deformation. Furthermore, when several varieties of related materials are to be stored, the storage racks must be capable of being adjusted easily to the extent that supporting arms can be added to the rack or taken away to separately accommodate additional quantities of material.

It is known in this art that a vertical column in the nature of an I-beam attached to a suitable base can be provided with a readily adjustable horizontal cantilever arm to provide a storage rack of considerable strength and versatility, such rack being capable of having additional cantilever arms applied from time to time as needed. The cantilever arms are readily adjustable and are equipped with members whose vertically disposed and opposing channels frictionally engage the flanges of an I-beam type vertical column to provide a support arm of appreciable strength and stability. This type of cantilever rack is shown in U.S. Pat. Nos. 3,335,992 and 3,489,291; it is readily adjustable to various heights while at the same time allowing for the addition of a plurality of superimposed arms without having to remove the arms or slip them over the top of the column.

One area of technical design which has received attention in rack structure assemblies is the design of the clamp for connecting the cantilever arm to the column. As tapered-flange I-beam columns were replaced with parallel-flange columns, the need arose for a connector or clamp which could overcome the inherent weakness in the parallel-flange structure. Such a clamp would have to be capable of securely holding heavy loads and, at the same time, be easily maneuverable along the column to adjust the height of the arm. One exemplary clamp that addresses these and other problems is disclosed in U.S. Pat. No. 4,519,512 issued to D. Frazier et al. on May 28, 1985. The connector therein described comprises a U-shaped channel having a web portion and a pair of flange portions. A pair of trapezoidshaped cut-outs are formed in the web, where the trapezoids are used to engage the flange portions of the associated column at a medial location, reducing the weakness problem inherent in parallel-flange columns. Although this connector overcomes the problems of the prior art, the structure is rather difficult to manufacture and the trapezoid shapes must be modified when necessary to connect to columns of different dimensions. These difficulties thus reduce the design flexibility of the connector and, as a result, add significant cost when a new connector must be developed to be used with a different size rack structure.

Thus, a need remains in the art for a connector design that is relatively easy to manufacture and flexible in design, while remaining useful in the areas described above.

SUMMARY OF THE INVENTION

This connector need is addressed by the present invention, which relates to a structural channel connector and, more particularly, a connector that is easily formed from a conventional structural channel by either brake press or punch and dies, or rolling. Specifically, a structural channel is modified to include one or more indents or detents so as to provide means for attaching the connector to the vertical column of a rack structure at desired locations.

In an exemplary embodiment of the present invention, a conventional structural channel is modified using an appropriately designed punch and die to efficiently introduce an indent along the web of a channel. This indent and one flange of the channel are then used as connecting arms that are disposed on either side of a vertical column flange. By virtue of the punch and die design, the indent includes a tapered sidewall, suitable for engaging the vertical column flange. Accordingly, since only one flange of the channel is used, a plate may be substituted for a channel and an appropriate method used to form the necessary "indent" or "detent" and flange end termination on the plate.

In an alternative embodiment, the channel is inverted such that the punch contacts the backside of the channel web and forms a detent in the web structure. The resulting detented channel may thus be used as a step beam for pallet rack structures.

Various other combinations of indents and detents may be formed in a structural channel for a variety of purposes, including but not limited to, wheel tracks for pushback storage arrangements, guide rails, guard rails, etc.

The modified channel structure of the present invention can be formed using a variety of methods including the punch and die means described above. Alternatively, a brake press may be used as well as rolling a conventional structural channel.

Various and other modifications and uses of the present invention will become apparent during the course of the following discussion and by reference to the accompanying drawings.

BRIEF DESCRIPTION OF THE DRAWINGS

Reference will now be made to the drawings, where like numerals represent like parts in several views:

FIG. 5 is an exploded view of a portion of the rack structure of FIG. 1 taken along line 5—5;

FIG. 8 is a cut-away end view of an alternative three leg connector for use in the rack structure of FIG. 1; and FIG. 9 is a cut-away end view of a two-leg connector suitable for use in the rack structure of FIG. 1.

DETAILED DESCRIPTION OF THE PREFERRED EMBODIMENTS

Figure 1:
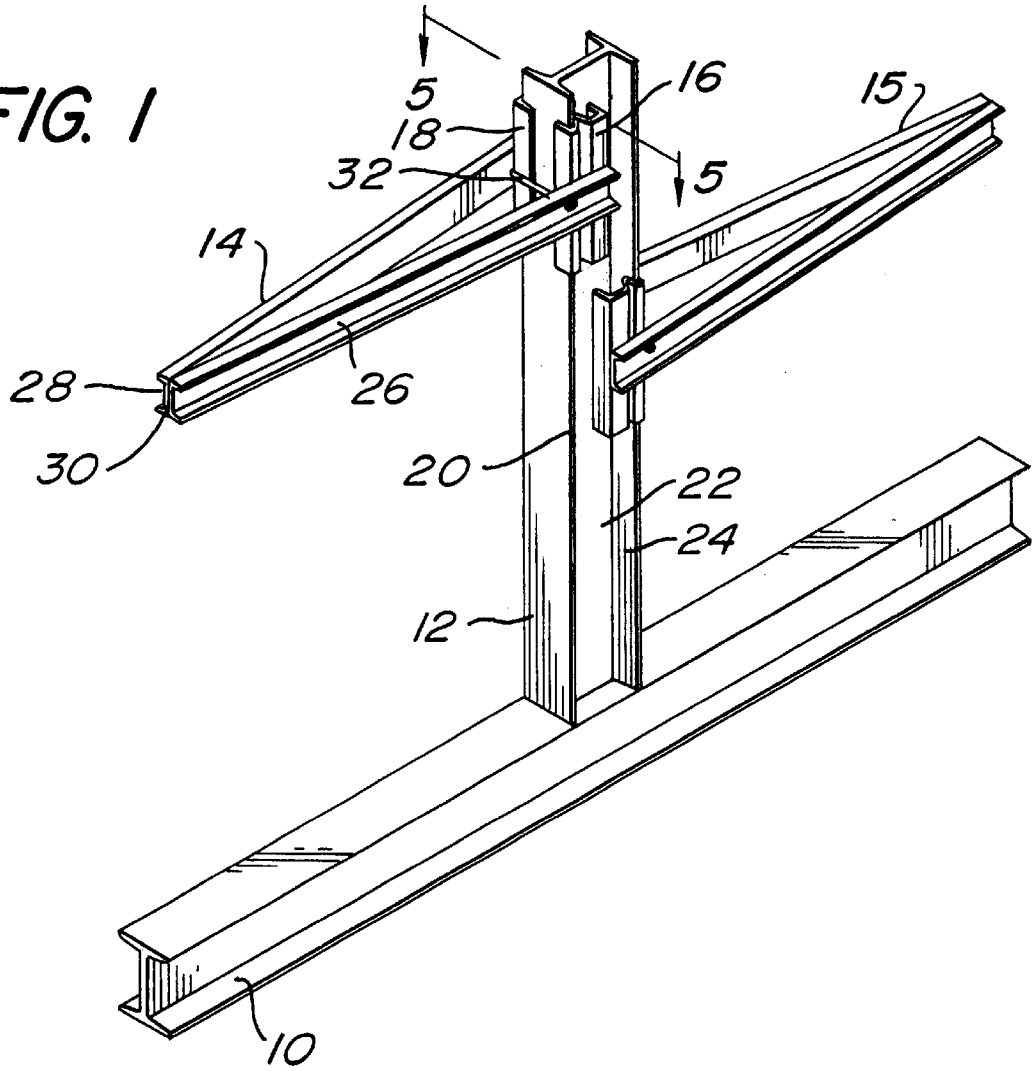
FIG. 1 is a perspective view of a double-sided cantilever rack structure utilizing the structural channel connector of the present invention.

In FIG. 1, there is shown an exemplary cantilever rack structure comprised of a base 10 in the form an I-beam resting on one of its flanges, a vertical column 12 in the form of an I-beam welded at its lower end onto the top flange of base 10 and a pair of connectors 16 and 18 for mounting cantilever arm 14 onto flange 20 of column 12 so that it might extend generally perpendicularly thereto. Column 12 comprises a vertical web 22 extending between flange 20 and a flange 24 on which is mounted another cantilever arm 15 extending from column 12 in the opposite direction from cantilever arm 14.

Base 10 and column 12 form a rigid welded assembly known in the art as a double-sided upright which, in FIG. 1, is shown with cantilever arms mounted thereon. In a typical storage rack designed for storing objects of some length, a row of such uprights is provided and these are equipped with cantilever arms and horizontally disposed bracing between pairs of adjacent uprights, the arms being adjusted to an appropriate height for supporting the objects which are to placed thereon. It will be apparent that there may be also provided single-sided uprights comprised of vertical columns with arms mounted to extend in one direction only, Cantilever arm 14 is comprised of a pair of U-shaped channel members 26 and 28 arranged back-to-back and secured together at their extended end 30 by suitable means as, for example, by weld or bolt means. Meanwhile, the opposite ends of the U-shaped channel members 26 and 28 are joined to connectors 16 and 18 by a weld or similar means and are joined to vertical column 12 by a connecting bolt 32. The connecting bolt 32 extends between channel members 26 and 28 and, when tightened, brings them into frictional engagement with flange 20 of column 12. By loosening and tightening bolt 32, the connectors 16 and 18 may be made to move in tandem and frictionally engage flange 20 to create a clamping effect on the flange portion 20 of column 12. The loosening of bolt 32 allows an assembler to vertically adjust arm 14 and position it at any desired height. Also, the loosening of bolt 32 permits horizontal adjustment of the position of channel members 26 and 28 of arm 14, which adjustment is useful in positioning arm 14 with relation to web 22 of column 12. Once arm 14 is in position, the load applied thereto creates a binding action between connectors 16 and 18 and flange 20, and this engagement serves to maintain arm 14 in a fixed position. Moreover, the heavier the load, the greater the binding effect.

Figure 2:
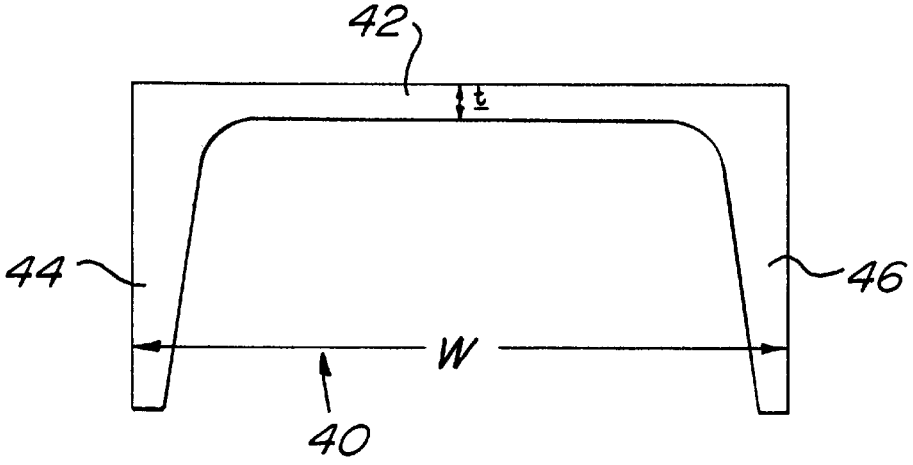
FIG. 2 is a cut-away end view of a conventional structural channel.

A cut-away end view of an exemplary structural channel 40 is illustrated in FIG. 2. As described below, it is the teaching of the present invention that such a conventional channel may be modified to form a structural connector, such as connectors 16 and 18, discussed above in association with FIG. 1. Channel 40 is defined by its web 42 extending between a first flange 44 and a second flange 46.

Figure 3:
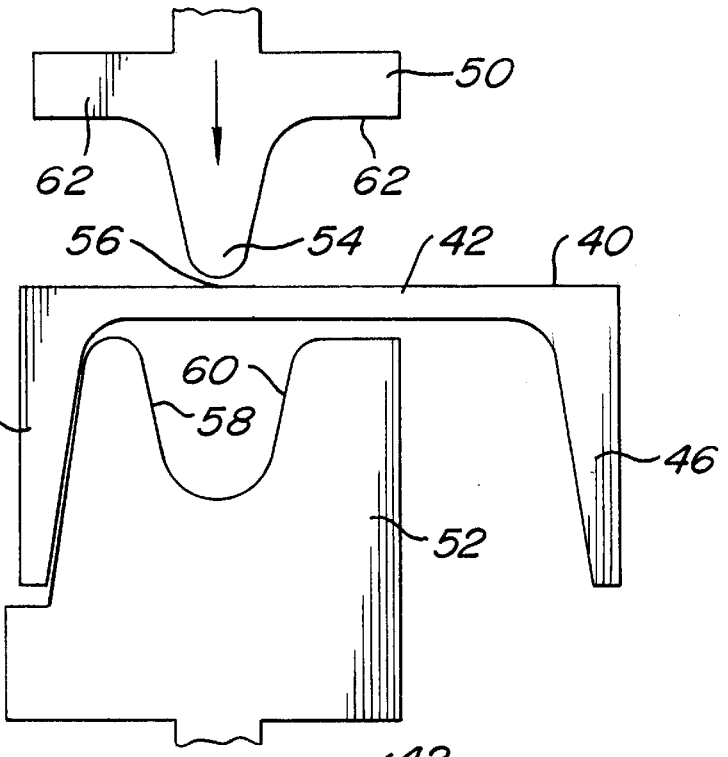
FIG. 3 illustrates an exemplary punch and die for modifying a structural channel in accordance with the present invention.
Figure 4:
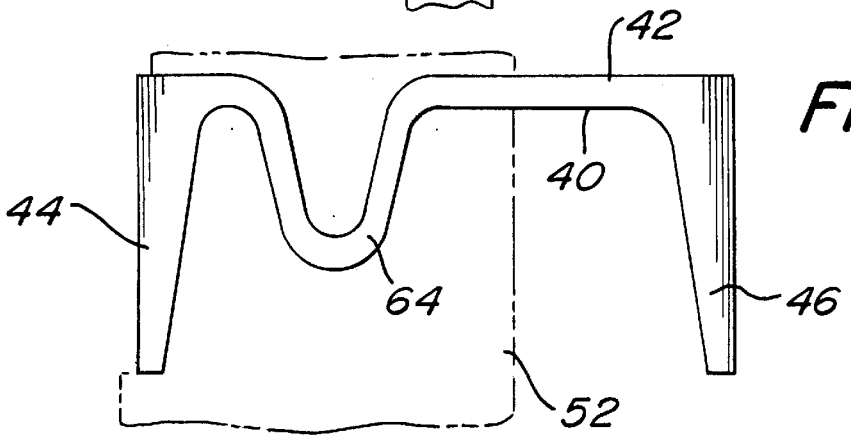
FIG. 4 is a modified structural channel formed to include an indent.

FIG. 3 illustrates an exemplary punch 50 and die 52 that may be used to modify conventional structural channel 40 (illustrated in phantom) to form the indented connector structure of the present invention. In particular, channel 40 is inserted between punch 50 and die 52, with tip 54 of punch 50 directed downward, as indicated by the arrow, toward web 42 of connector 40 in the precise location 56 where it is desired to form the indent. Web portion 56 will then enter channel 58 of die 52, as guided by sidewalls 60 of die 52. Flange portions 62 of punch 50 function as a stop against the remaining web portion 42, preventing web 42 from moving upward in opposition to the downward motion of web portion 56. FIG. 4 illustrates a finished structural channel connector 16 as used in the system of FIG. 1, illustrating the location of indent 64, formed using the punch and die arrangement as discussed above. FIG. 5 is a partial view of the system of FIG. 1, clearly depicting the attachment of connectors 16 and 18 against flange 20 of vertical column 12. As shown, in accordance with the present invention, flange 20 is disposed between flange 42 and indent 64. An advantage of the connector formation process of the present invention is that the location of indent 64 with respect to flange 42 may be altered to accommodate different thicknesses in the flange portions of the vertical column. That is, by simply moving the location of the punch and die with respect to flange 42, indent 64 may be moved either closer to or further from the flange, as necessary. This advantage is considered to be a distinct improvement over prior art designs.

As mentioned above, there are other methods of forming structural channel 16 that fall within the spirit and scope of the present invention. For example, a brake press may be used in the manufacturing line, subsequent to the formation of conventional channel 40 to press the indent in the desired location. A cold rolling process may also be used. In general, any process of modifying a structural channel member to form an indent along the web is considered to fall within the spirit and scope of the present invention.

Figure 6:
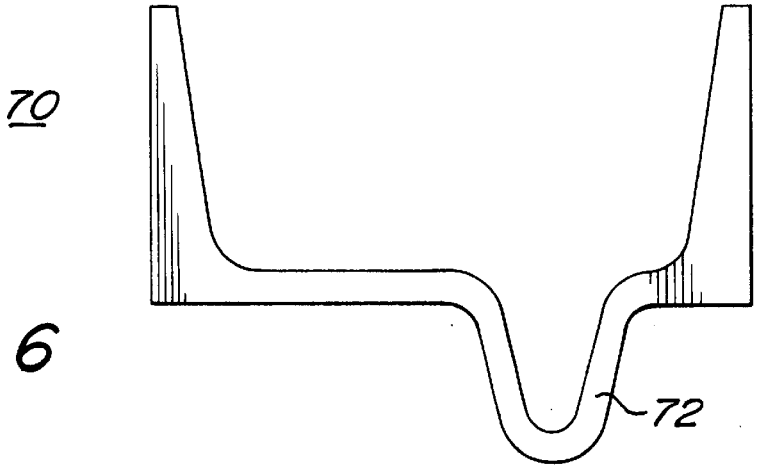
FIG. 6 is a modified structural channel, formed to include a detent.
Figure 7A:
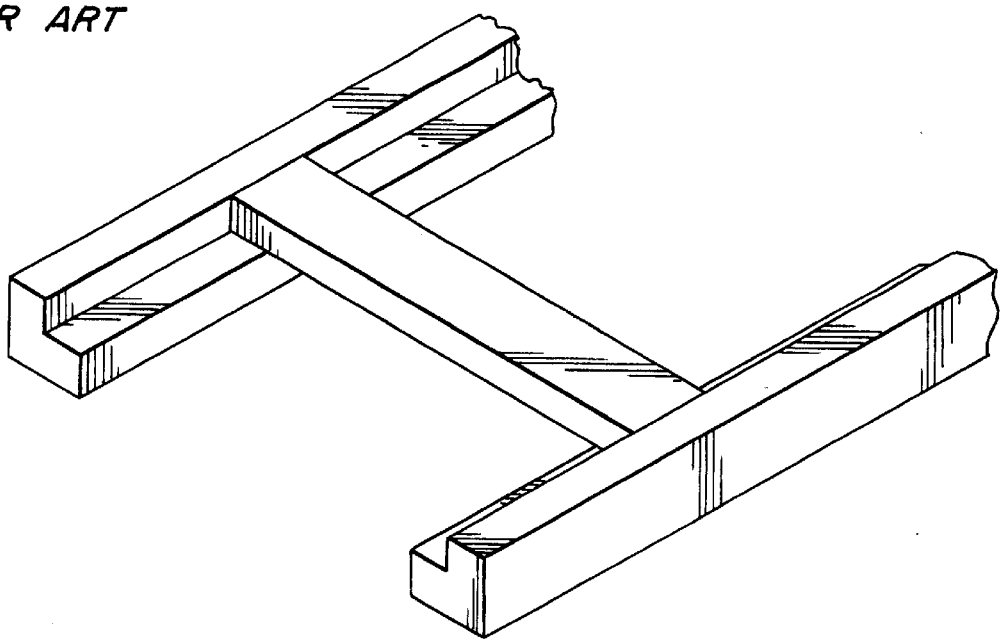
FIG. 7A PRIOR ART
FIG. 7A illustrates a portion of a step beam rack as it exists in the prior art.
Figure 7B:
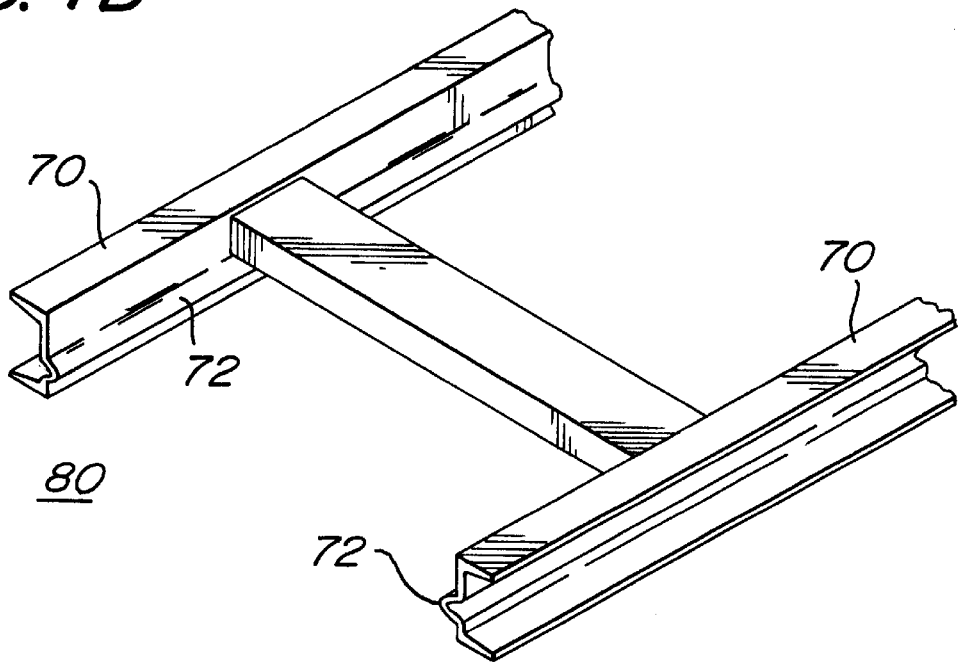
FIG. 7B illustrates a portion of a step beam rack structure equipped with the detented structural channel structure of the present invention.

Instead of forming an indent and using the modified structural channel member as a connector, a conventional structural channel such as channel 40 of FIG. 2 may be modified to include a "detent". Referring back to the punch and die arrangement of FIG. 3, by simply inverting channel 40, a detent may be formed along an interior region 66 of web 42. FIG. 6 illustrates an exemplary step beam connector 70 formed to include a detent 72 as described above. Such a connector may be used in conventional systems, such as shelf system 80 of FIG. 7. In this structure, a pair of connectors 70 may be disposed parallel to each other, with detents 72 facing inward toward each other. A beam, wood support, or any other suitable support member may then be disposed to rest upon the "lip" formed by detents 72. As with the arrangement described above, the location of the detent, with respect to flanges 74 and 76 of connector 70 can be controlled at the discretion of the user.

As mentioned above, a processed plate structure may be used in place of a structural channel member. FIG. 8 illustrates an end view of a plate 90 that is formed to include flanged end members 92 and 94, with an indent 96 formed therebetween. Plate 90 can therefore be substituted for connector 16 in the rack structure of FIG. 1. Indeed, since only one flange and the indent are used to provide the connection between the arm and the column, plate 90 can be processed to form only indent 96 and second flange 94, as shown in FIG. 9. In general, any suitable plate or channel may be processed in accordance with the present invention to include various indents or detents required for structural support purposes. All of these variations are obvious to those skilled in the art and are considered to fall within the spirit and scope of the present invention.

What is claimed is:

1. A modified structural channel for frictionally engaging the flange of an I-beam, said channel comprising a web region disposed between a pair of flanged channel ends, the channel comprising a width W defined as the distance between the pair of flanged channel ends, wherein the web region is formed to comprise a length W' greater than the channel width W and includes at least one indented or detented portion, said indented portion combining with a flanged end to form an opening having tapered sidewalls for frictionally engaging therebetween the flange of an I-beam.

2. A modified structural channel as defined in claim 1 wherein the web region is formed to include an indented portion extending in the same direction as the flanged ends and separated therefrom by a predetermined distance.

3. A cantilever rack system comprising:

a vertical column including a generally vertically extending web and flange, said flange having portions extending in both directions from said web, each flange portion having an outer face and an inner face, a cantilever arm, and a pair of connectors for mounting said cantilever arm on said flange of said column to extend generally perpendicularly from the outer faces of said flange portions, each of said connectors being secured to said arm and adapted to be mounted on said column at one of said flange portions, each of said connectors comprising a modified structural channel member comprising at least one of flanged end and a web region extending perpendicularly therefrom, the web including an indented portion formed a predetermined distance from the at least one flanged end so as to grip the inner and outer faces of an associated flange portion between said at least one flanged end and said indented web portion.

4. A cantilever rack system as defined in claim 3 wherein at least one connector comprises a plate member formed to comprise a flanged end portion and an indented web region at a predetermined spaced-apart location from said flanged end portion.

5. A cantilever rack system as defined in claim 3 wherein at least one connector comprises a plate member formed to comprise a pair of flanged end portions with an indented web region formed at a predetermined location between said pair of flanged end portions.

6. A cantilever rack system as defined in claim 3 wherein at least one connector comprises a U-shaped channel member comprising a pair of flanged end portions with an indented web region formed at a predetermined location between said pair of flanged end portions.

7. A shelf support system including:

a first step beam comprising a modified structural channel member defined by a pair of flanged end portions and a web extending therebetween, the web modified to include a detented portion extending in an opposite direction from said pair of flanged end portions;

a second step beam comprising a modified structural channel member defined by a pair of flanged end portions and a web extending therebetween, the web modified to include a detented portion extending in an opposite direction from said pair of flanged end portions, wherein said first and second step beams are disposed parallel to each other with the associated detented portions facing inward toward each other such that a shelf support member may be disposed upon the pair of detented portions, using said pair of detented portions as a shelf support member.

8. A method of modifying a structural channel member, the method comprising the steps of:

a) providing a structural channel member defined as including a pair of flanged end portions and a web portion extending therebetween, the web defined as comprising an inner surface and an outer surface;

b) processing the web portion by applying a force at a predetermined location along either surface of said web;

c) maintaining said force until a predetermined web shape is obtained.

9. The method as defined in claim 8 wherein in performing step b), the force is applied to the outer surface of the web to form an indented web region.

10. The method as defined in claim 8 wherein in performing step b), a punch and die combination is used to apply said force.

11. The method as defined in claim 8 wherein in performing step b), a rolling method is used to apply said force.

12. A modified structural channel comprised of a web region disposed between a pair of flanged channel ends, said channel comprising a width W defined as the distance between the pair of flanged channel ends, wherein the web region is formed to comprise a length W' greater than the channel width W and includes at least one detented portion.

13. A modified structural channel as defined in claim 12 wherein the detented portion extends in a direction opposite the flanged ends and is separated therefrom by a predetermined distance.

14. A method of modifying a structural channel member, said method comprising the following steps:

(a) providing a structural channel member defined as including a pair of flanged end portions and a web portion extending therebetween, the web defined as comprising an inner surface and an outer surface; and (b) processing the web portion by applying a force at a predetermined location along the inner surface of said web to form a detented web region.

15. The method as defined in claim 8 wherein in performing step (b), a punch and die combination is used to apply said force.

16. The method as defined in claim 8 wherein in performing step (b), a rolling method is used to apply said force.

17. The structural channel of claim 1 in which the tapered sidewalls of said opening form a radiused base.

* * * * *